United States Patent [19]

Sato et al.

[11] Patent Number: 4,675,277

[45] Date of Patent: Jun. 23, 1987

[54] HEAT DEVELOPABLE LIGHT-SENSITIVE MATERIAL

[75] Inventors: Kozo Sato; Hiroshi Kitaguchi; Hiroyuki Hirai, all of Minami-ashigara, Japan

[73] Assignee: Fuji Photo Film Co., Ltd., Kanagawa, Japan

[21] Appl. No.: 780,132

[22] Filed: Sep. 25, 1985

[30] Foreign Application Priority Data

Sep. 25, 1984 [JP] Japan ..... 59-199892

[51] Int. Cl.[4] ..... G03C 1/06

[52] U.S. Cl. ..... 430/448; 430/617; 430/619; 430/620; 430/203; 430/559; 430/562; 430/955; 430/564

[58] Field of Search ..... 430/955, 619, 620, 203, 430/617, 564, 448, 559, 562

[56] References Cited

U.S. PATENT DOCUMENTS

| | | | |
|---|---|---|---|
| 3,847,612 | 11/1974 | Winslow | 430/203 |
| 4,220,709 | 9/1980 | de Mauriac | 430/620 |
| 4,430,420 | 2/1984 | Adin | 430/619 |
| 4,507,380 | 3/1985 | Naito et al. | 430/619 |

*Primary Examiner*—Won H. Louie

*Attorney, Agent, or Firm*—Sughrue, Mion, Zinn Macpeak & Sons

[57] ABSTRACT

A heat developable light-sensitive material comprising a support having provided thereon at least a light-sensitive silver halide, a binder, and a compound capable of ring-closure to produce a benzimidazole ring upon heat development can be developed to an increased maximum density with less fogging at a relatively low temperature in a short period of time.

9 Claims, No Drawings

HEAT DEVELOPABLE LIGHT-SENSITIVE MATERIAL

FIELD OF THE INVENTION

This invention relates to a heat developable light-sensitive material capable of producing an image upon heat development.

BACKGROUND OF THE INVENTION

Heat developable light-sensitive materials and image producing processes associated therewith are well known in the art as described in "The Basic Photographic Engineering", Corona Publishing K.K., pages 553–555 (1979); "Image Information", page 40 (April, 1978); and "Neblett's Handbook of Photography and Reprography", 7th Ed., Van Nostrand Reinhold Company, pages 32–33.

Exemplary methods for producing color images include a method using a dye-releasing material in the form of a coupler (see U.S. Pat. Nos. 3,531,286; 3,761,270; and 4,021,240; Belgian Pat. No. 802,519; *Research Disclosure,* pages 31–32, September 1975); a method using a dye-releasing material in the form of a compound having a nitrogen-containing heterocyclic radical incorporated in its dye moiety (see *Research Disclosure,* pages 54–58, May 1978); a method using silver dye bleaching (see *Research Disclosure,* pages 30–32, April 1976, ibid, pages 14–15, December 1976, and U.S. Pat. No. 4,022,617); and a method using a leuco dye (see U.S. Pat. Nos. 3,985,565 and 4,022,617).

These methods, however, have their own shortcomings and commonly suffer from the problem that development takes a relatively long time and the resulting image is markedly fogged with a low maximum density (Dmax).

In order to solve this problem, U.S. Pat. No. 4,500,626 proposes to use a reducing dye-releasing material capable of releasing a hydrophillic dye. This method has succeeded in overcoming the technical problems of the prior art to a great extent.

There is still the need for the development of an improved light-sensitive material which can be heat developed to a higher maximum density with less fogging at a lower temperature within a shorter heating time than the material described in the above-identified U. S. Patent.

SUMMARY OF THE INVENTION

It is, therefore, an object of the present invention to provide a heat-developable, photographic light-sensitive material which can be heat developed at a relatively low temperature within a relatively short heating time to a maximum density as high as possible with less fogging.

According to the present invention which achieves the above and other objects, there is provided a heat developable light-sensitive material comprising a support having provided thereon at least a light-sensitive silver halide, a binder, and a compound capable of ring-closure to produce a benzimidazole ring upon heat development.

DETAILED DESCRIPTION OF THE INVENTION

The heat-developable, photographic light-sensitive material of the present invention contains a compound capable of ring-closure to provide a benzimidazole ring upon heat development.

These compounds are well known in the field of organic chemistry and their typical examples are those represented by the following general formulae [I] through [XII]. All these compounds can produce benzimidazoles by heating or by oxidizing with silver ion upon heating.

(I)

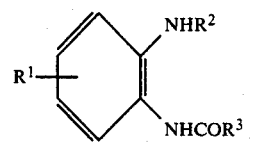

(II)

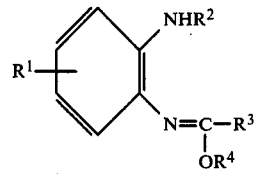

(III)

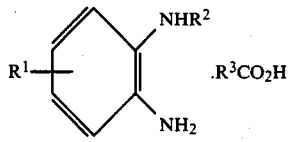

(IV)

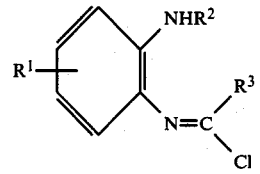

(V)

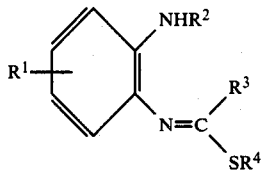

(VI)

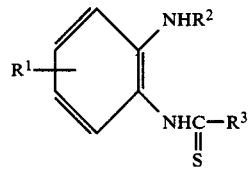

(VII)

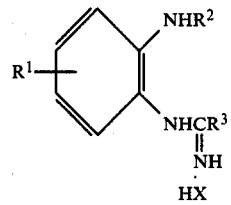

(VIII)

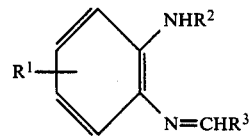

-continued (IX)

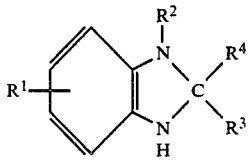

(X)

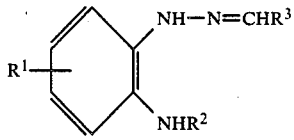

(XI)

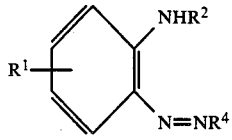

(XII)

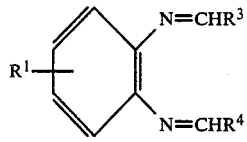

In the foregoing formulas [I] to [XII], $R^1$ preferably represents hydrogen atom;

a halogen atom such as chlorine, bromine, and iodine;

a substituted or unsubstituted alkyl radical having from 1 to 12 carbon atoms such as methyl, butyl, and dodecyl radicals;

a substituted or unsubstituted cycloalkyl radical having from 5 to 10 carbon atoms such as cyclopentyl and cyclohexyl radicals a substituted or unsubstituted alkenyl radical having from 1 to 12 carbon atoms such as propenyl, isopropenyl, and styryl radicals;

a substituted or unsubstituted aryl radical having from 6 to 14 carbon atoms such as phenyl and tolyl radicals;

a substituted or unsubstituted aralkyl radical having from 7 to 14 carbon atoms such as benzyl, β-phenetyl, and α-methylbenzyl radicals;

an alkoxy radical having from 1 to 12 carbon atoms such as methoxy, ethoxy, and methoxyethoxy radicals;

a substituted or unsubstituted aryloxy radical such as phenoxy, p-chlorophenoxy, and p-methoxyphenoxy radicals;

a cyano radical;

a nitro radical;

an alkylsulfonyl radical such as methylsulfonyl, ethylsulfonyl, and methoxyethylsulfonyl radicals;

an arylsulfonyl radical such as phenylsulfonyl, toluenesulfonyl, and p-chlorophenylsulfonyl radicals;

a substituted or unsubstituted sulfamoyl radical such as sulfamoyl, dimethylsulfamoyl, and morpholinosulfamoyl radicals;

a substituted or unsubstituted carbamoyl radical such as carbamoyl, dimethylcarbamoyl, and piperidinocarbamoyl radicals;

a substituted or unsubstituted amino radical such as dimethylamino, anilino, and N-methylanilino radicals;

an alkylacylamino radical such as acetylamino and pivaloylamino radicals;

an arylacylamino radical such as benzoylamino and toluoylamino radicals;

an alkylsulfonylamino radical such as methylsulfonylamino and octylsulfonylamino radicals;

an arylsulfonylamino radical such as phenylsulfonylamino and tolylsulfonylamino radicals; or the like.

The presence of plural $R^1$ radicals is also contemplated wherein $R^1$ radicals may be the same or different.

Also preferably, $R^2$, $R^3$, and $R^4$ individually represent hydrogen atom;

a substituted or unsubstituted alkyl radical having from 1 to 8 carbon atoms such as methyl, ethyl, and methoxyethyl radicals;

a substituted or unsubstituted aralkyl radical having from 7 to 14 carbon atoms such as benzyl, β-phenetyl, and α-methylbenzyl radicals;

a substituted or unsubstituted aryl radical having from 6 to 14 carbon atoms such as phenyl, tolyl, p-chlorophenyl, and p-methoxyphenyl radicals;

a substituted or unsubstituted amino radical such as amino, methylamino, and anilino radicals;

an alkoxy radical having from 1 to 8 carbon atoms such as methoxy and methoxyethoxy radicals;

an alkylthio radical such as methylthio and methoxyethylthio radicals; or the like.

Most preferred among those compounds having general formulas [I] to [XII] are those compounds having general formulas [I], [II], [VII], and [VIII].

Shown below are some illustrative, but non-limiting examples of the compounds capable of ring-closure to produce a benzimidazole ring upon heat development which can be used in the present invention.

(1)

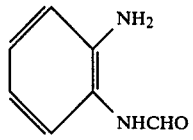

(2)

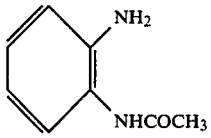

(3)

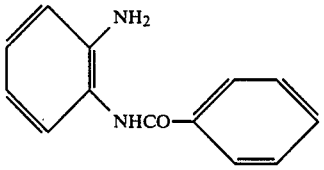

(4)

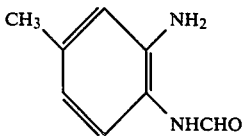

(5)

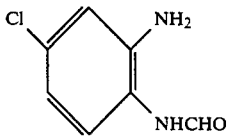

-continued
(6)
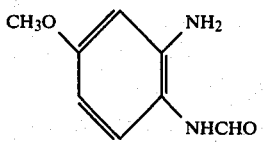
(7)
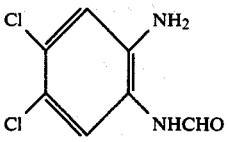
(8)
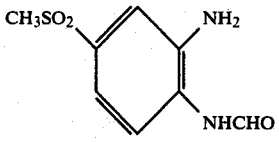
(9)
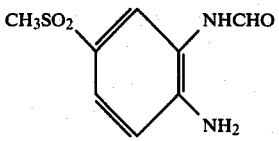
(10)
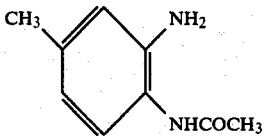
(11)
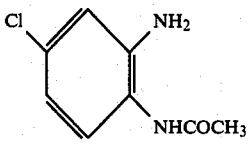
(12)
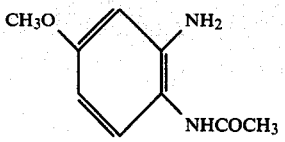
(13)
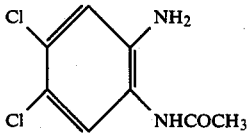
(14)
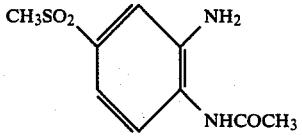
(15)
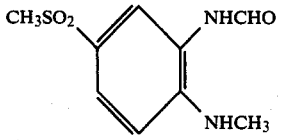
-continued
(16)
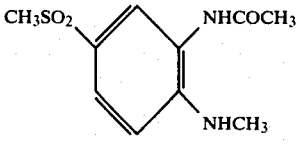
(17)
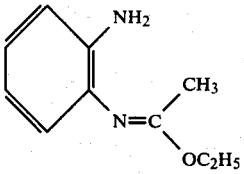
(18)
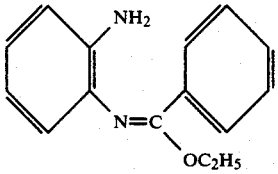
(19)
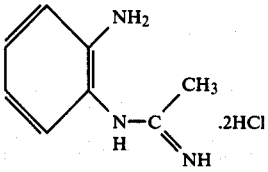
(20)
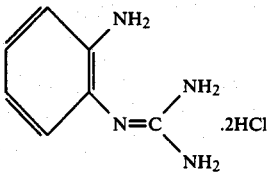
(21)
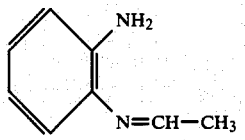
(22)
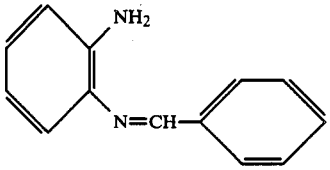
(23)
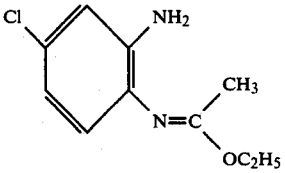
(24)
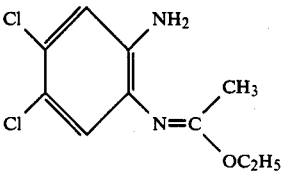

-continued (25)

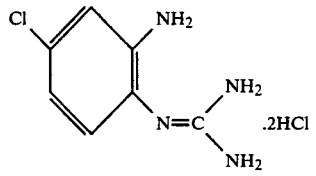

(26)

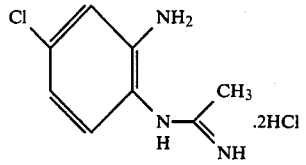

(27)

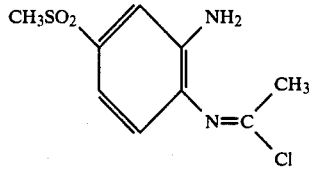

(28)

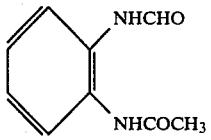

(29)

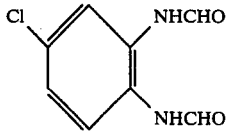

(30)

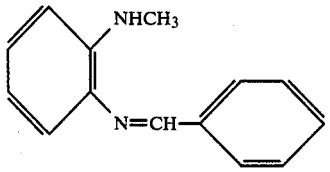

The compounds capable of ring-closure to produce a benzimidazole ring upon heat development may be synthesized by a well-known process.

One illustrative synthesis process is described in detail in Klaus Hofmann, "The Chemistry of Heterocyclic Compounds, Imidazole and Its Derivatives, Part I", pages 247–324, Interscience Publishers, Inc., 1953.

An example is shown below.

Synthesis of compound No. 11

To a mixture of 50 ml of acetic anhydride and two drops of sulfuric acid was added 34.5 grams of 4-chloro-2-nitroaniline in several portions. At the end of addition, the solution was heated at 50° C. for one hour and then allowed to cool. 300 ml of cold water was added to the solution to induce precipitation of crystals, which were removed by filtration and washed with water. There were obtained the crystals of 2-acetylamino-5-chloronitrobenzene in a yield of 41.8 grams.

A mixture of 60 grams of reduced iron, 4 grams of ammonium chloride, 120 ml of isopropanol, and 40 ml of water was heated to reflux. To the refluxing mixture was added 30 grams of the above-obtained crystals in several portions. At the end of addition, the solution was heated under reflux for a further 30 minutes. The hot solution was filtered through Celite (trade name, Johns-Manville) and the filtrate was cooled with ice. The precipitating crystals of compound No. 11 were removed by filtration and washed with aqueous methanol. The product having a melting point of 142°–144° C. was obtained in a yield of 15.7 grams.

The compounds capable of ring-closure to provide a benzimidazole ring upon heat development are effective particularly when combined with spectrally sensitized light-sensitive silver halide emulsions. More specifically, the compounds can increase image density to a greater extent particularly when combined with spectrally sensitized light-sensitive silver halide emulsions.

The spectral sensitization of silver halide emulsions is achieved with methine dyes and other sensitizing dyes. Examples of the dyes useful for spectral sensitization include cyanine dyes, merocyanine dyes, complex cyanine dyes, complex merocyanine dyes, holopolar cyanine dyes, hemicyanine dyes, styryl dyes, and hemioxonole dyes. Particularly useful dyes are cyanine dyes, merocyanine dyes, and complex merocyanine dyes. For these dyes, any nuclei generally utilized for cyanine dyes can be applied as basic heterocylic ring nuclei. For example, applicable are pyrroline nuclei, oxazoline nuclei thiazoline nuclei, pyrrole nuclei, oxazole nuclei, thiazole nuclei, selenazole nuclei, imidazole nuclei, tetrazole nuclei, pyridine nuclei, etc.; and nuclei of the foregoing nuclei having cycloaliphatic hydrocarbon rings fused thereto and nuclei of the foregoing nuclei having aromatic hydrocarbon rings fused thereto, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms.

For the merocyanine and complex merocyanine dyes, 5- or 6-membered heterocyclic nuclei are applicable as a nucleus having a ketomethylene structure, for example, a pyrozolin-5-one nucleus, thiohydantoin nucleus, 2-thiooxazolidine-2,4-dione nucleus, thiazolidine-2,4-dione nucleus, rhodanine nucleus, thiobarbituric acid nucleus, etc.

These sensitizing dyes may be used alone or in combination. Combinations of sensitizing dyes are often used for supersensitization purposes.

Examples of useful sensitizing dyes are described in, for example, West German Pat. No. 929,080; U.S. Pat. Nos. 2,493,748; 2,503,776; 2,519,001; 2,912,329; 3,656,959; 3,672,897; 3,694,217; 4,025,349; and 4,046,572; U.K. Pat. No. 1,242,588; Japanese Patent Publication Nos. 14,030/69 and 24,844/77.

The amount of the sensitizing dye used is from 0.001 g to 20 g, and preferably from 0.01 g to 2 g per 100 g of silver of the silver halide emulsion.

The compounds capable of ring-closure to produce a benzimidazole ring upon heat development according to the invention may be used in widely varying amounts. The effective range is less than about 100% by weight, preferably 0.1% to 50% by weight of the weight of the light-sensitive silver halide.

Any unit and layer arrangements may be used with the light-sensitive materials of the present invention. The compounds capable of ring-closure to produce a benzimidazole ring upon heat development may be added to any desired layer in the light-sensitive material, for example, a light-sensitive emulsion layer or a dye-providing-material containing layer when these layers are separately formed, or an intermediate or protective layer, preferably the silver halide emulsion layer or a layer adjacent thereto. The compounds capable of ring-closure to produce a benzimidazole ring upon heat development may be used alone or in admixture of two or more.

According to the present invention, silver can be utilized as an image forming substance. Further, various other image forming substances can be employed in various image forming processes.

For instance, couplers may be employed which are capable of forming color images upon reaction with an oxidation product of developing agents which are commonly used in the well-known liquid development. Examples of magenta couplers include 5-pyrazolone couplers, pyrazolobenzimidazole couplers, cyanoacetylcoumarone couplers and open chain acylacetonitrile couplers, etc. Examples of yellow couplers include acylacetamide couplers such as benzoylacetanilides and pivaloylacetanilides, etc. Examples of cyan couplers include naphthol couplers and phenol couplers, etc. It is preferred that these couplers be nondiffusible substances which have a hydrophobic group called a ballast group in the molecule thereof or be polymerized substances. The couplers may be any of the 4-equivalent and 2-equivalent types with respect to silver ion. Further, they may be colored couplers having a color correction effect or couplers which release a development inhibitor as development proceeds (so-called DIR couplers).

Also employable are dyes capable of forming positive color images by a light-sensitive silver dye bleach processes, for example, those described in *Research Disclosure,* No. 14433, pages 30–32 (April 1976), ibid., No. 15227, pages 14–15 (December 1976) and U.S. Pat. No. 4,235,957, etc.; leuco dyes as described, for example, in U.S. Pat. No. 3,985,565 and 4,022,617, etc.; and dyes having a nitrogen-containing heterocyclic group introduced as described in *Research Disclosure,* No. 16966, pages 54–58 (May 1978).

In addition, use may be made of dye-providing substances which release a mobile dye by effecting coupling reaction with a reducing agent oxidized by oxidation-reduction reaction with a silver halide or organic silver salt at high temperatures as described in European Pat. Nos. 67,455 and 79,056, West German Pat. No. 3,217,853, etc.; and dye-providing substances which release a mobile dye as the result of oxidation-reduction reaction with a silver halide or organic silver salt at high temperatures as described in European Pat. Nos. 66,282 and 76,492, West German Pat. No. 3,215,485, Japanese Patent Application Nos. 28928/83 and 26008/83, etc.

Preferred dye-providing substances which can be employed in these processes may be represented by the following formula (CI):

$$(\text{Dye-X})_q\text{-Y} \qquad \text{(C I)}$$

wherein Dye represents a dye which becomes mobile when it is released from the molecule of the compound represented by formula (C I); X represents a simple bond or a connecting group; Y represents a group which releases Dye in correspondence or countercorrespondence to light-sensitive silver salts having a latent image distributed imagewise, the diffusibility of Dye released being different from that of the compound represented by formula (C I) and q represents an integer of 1 or 2.

The dye represented by Dye is preferably a dye having a hydrophilic group. Exmaples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form having temporarily shortened wavelengths, the color of which is recoverable in the development processing.

More specifically, those dyes described in European Patent Application No. 76,492 may be utilized.

Examples of the connecting group represented by X include —NR— (wherein R represents a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

Y in formula (C I) will be described in greater detail.

In one embodiment, Y is selected so that the compound represented by the general formula (C I) is a nondiffusible image-forming compound which is oxidized as a result of development, thereby undergoing self-cleavage and releasing a diffusible dye.

An example of Y which is effective for compounds of this type is an N-substituted sulfamoyl group. For example, a group represented by formula (C II) is illustrated for Y.

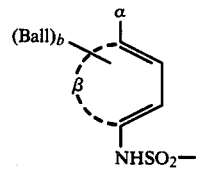

(C II)

wherein $\beta$ represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like.

$\alpha$ represents a group of —$OG^{11}$ or —$NHG^{12}$ wherein $G^{11}$ represents hydrogen or a group which forms a hydroxy group upon hydrolysis, and $G^{12}$ represents hydrogen, an alkyl group containing 1 to 22 carbon atoms or a hydrolyzable group, Ball represents a ballast group, and b represents an intgeger of 0, 1 or 2.

Specific examples of Y of this type are described in Japanese Patent Application Kokai Nos. 33826/73 and 50736/78.

Other examples of Y suitable for this type of compound are those represented by the following general formula (C III):

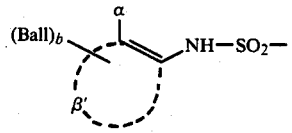

(C III)

wherein Ball, $\alpha$, and b are as defined in (C II), $\beta'$ represents atoms necessary for forming a carbon ring, e.g., a benzene ring which may be fused with another carbon ring or a hetero ring to form a naphthalene ring, quinoline ring, 5,6,7,8-tetrahydronaphthalene ring, chroman ring or the like. Specific examples of Y of this type are described in Japanese Patent Application Kokai Nos. 113624/76, 12642/81, 16130/81, 4043/82 and 650/82, and U.S. Pat. No. 4,053,312.

Further examples of Y suitable for this type of compound are those represented by the following formula

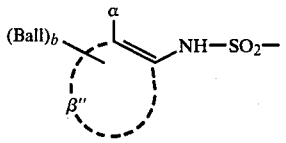

(C IV)

wherein Ball, $\alpha$, and b are as defined in formula (C II) and $\beta''$ represents atoms necessary for forming a hetero ring such as a pyrazole ring, a pyridine ring or the like, the hetero ring being optionally bound to a carbon ring or a hetero ring. Specific examples of Y of this type are described in Japanese Patent Application Kokai No. 104343/76.

Still further examples of Y suitable for this type of compound are those represented by the following formula (C V):

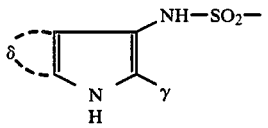

(C V)

wherein $\gamma$ preferably represent hydrogen, a substituted or unsubstituted alkyl, aryl or heterocyclic group, or —CO—$G^{21}$; where $G^{21}$ represents —$OG^{22}$, —$SG^{22}$ or

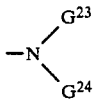

(wherein $G^{22}$ represents hydrogen, an alkyl group, a cycloalkyl group or an aryl group, $G^{23}$ is as defined for $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a fused benzene ring.

Specific examples of Y of this type are described in Japanese Patent Application Kokai Nos. 104343/76, 46730/78, 130122/79 and 85055/82.

Still further examples of Y suitable for this type of compound are those represented by the formula (C VI):

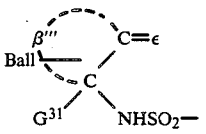

(C VI)

wherein Ball is as defined in formula (C II); $\epsilon$ represents an oxygen atom or =$NG^{32}$ wherein $G^{32}$ represents hydroxy or an optionally substituted amino group, (examples of $H_2N$—$G^{32}$ usable in forming the group =$NG^{32}$ including hydroxylamine, hydrazines, semicarbazides, thiosemicarbazides, etc.); $\beta'''$ represents a saturated or unsaturated nonaromatic 5-, 6- or 7-membered-hydrocarbon ring; and $G^{31}$ represents hydrogen or a halogen atom (e.g., a fluorine atom, a chlorine atom, a bromine atom, etc.).

Specific examples of Y of this type are described in Japanese Patent Application Kokai Nos. 3819/78 and 48534/79.

Other examples of Y of this type of compound are described in Japaense Patent Publication Nos. 32129/73 and 39165/73, Japanese Patent Application Kokai No. 64436/74, U.S. Pat. No. 3,443,934, etc.

Still further examples of Y are those represented by the following formula (C VII):

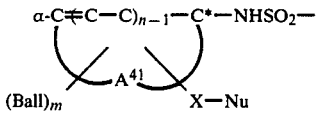

(C VII)

wherein $\alpha$ represents $OR^{41}$ or $NHR^{42}$; $R^{41}$ represents hydrogen or a hydrolyzable component; $R^{42}$ represents hydrogen or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be as defined in formula (C II). Specific examples of Y of this type are described in Japanese Patent Application Kokai No. 20735/82.

Still further examples of the substances represented by formula (C I) are dye-providing, non-diffusible substances which release a diffusible dye in the presence of a base as a result of self cyclization or the like but which, when reacted with an oxidation product of a developing agent, substantially never release the dye.

Examples of Y effective for this type of compound are those which are represented by the formula (C VIII):

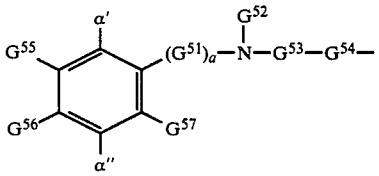

(C VIII)

wherein $\alpha'$ represents an oxidizable nucleophilic group such as a hydroxy group, a primary or secondary amino group, a hydroxyamino group, and a sulfonamido group, or a precursor thereof;

$\alpha''$ represents a dialkylamino group or any groups as defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO—or —CS—;

$G^{54}$ represents an oxygen atom, a sulfur atom, a selenium atom, a nitrogen atom or the like and, when $G^{54}$ represents a nitrogen atom, it may be substituted with hydrogen, a substituted or unsubstituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or any groups defined for $G^{52}$, and $G^{55}$ and $G^{56}$, when taken together, may form a 5- to 7-membered ring, and $G^{56}$ may further represent $$-(G^{51})_a-\overset{\overset{\displaystyle G^{52}}{|}}{N}-G^{53}-G^{54}-,$$

with the proviso that at least one of $G^{52}$, $G^{55}$, $G^{56}$ and $G^{57}$ represents a ballast group. Specific examples of Y of this type are described in Japanese Patent Application Kokai No. 63618/76.

Further exmaples of Y suitable for this type of compound are those having the following general formulae (C IX) and (C X):

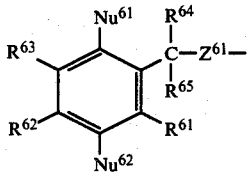

(C IX)

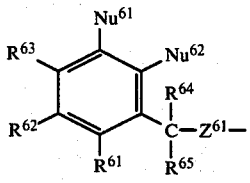

(C X)

wherein $Nu^{61}$ and $Nu^{62}$ may be the same or different and each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$ may be the same or different and each represents hydrogen, a hydrocarbon group or a substituted hydrocarbon group; with at least one of the substituents $R^{61}$, $R^{62}$, $R^{63}$, $R^{64}$ and $R^{65}$ having a ballast group, Ball, of a size enough to render the above-described compounds immobile. Specific examples of Y of this type are described in Japanese Patent Application Kokai Nos. 69033/78 and 130927/79.

Further examples of Y suitable for this type of compound are those which are represented by the formula of (CXI):

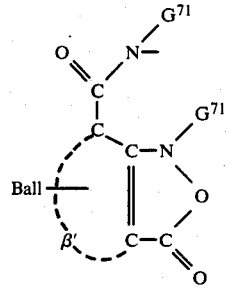

(CXI)

wherein Ball and $\beta'$ are as defined in formula (C III); and $G^{71}$ represents an alkyl group or a substituted alkyl group. Specific examples of Y of this type are described in Japanese Patent Application Kokai Nos. 111628/74 and 4819/77.

Still another type of compounds having the general formula (C I) include dye-providing, nondiffusible substances which themselves do not release any dye, but release a dye upon reaction with a reducing agent. These compounds may preferably be used in combination with compounds which mediate redox reaction (called electron donors).

Examples of Y effective for this type of compound are those represented by the formula (C XII):

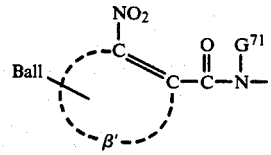

(C XII)

wherein Ball and $\beta'$ are as defined in the general formula (C III) and $G^{71}$ represents an alkyl group or a substituted alkyl group. Specific examples of Y of this type are described in Japanese Patent Application Kokai Nos. 35533/78 and 110827/78.

Further examples of Y suitable for this type of compound are those having the general formula (C XIII):

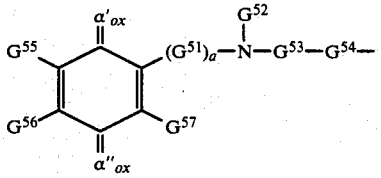

(C XIII)

wherein $\alpha'ox$ and $\alpha''ox$ represents groups capable of giving $\alpha'$ and $\alpha''$ upon reduction, respectively, and $\alpha'$, $\alpha''$, $G^{51}$, $G^{52}$, $G^{53}$, $G^{54}$, $G^{55}$, $G^{56}$, $G^{57}$ and a are as defined in formula (C VIII). Specific examples of Y described above are described in Japanese Patent Application Kokai No. 110827/78, U.S. Pat. Nos. 4,356,249 and 4,358,525.

Further examples of Y suitable for this type of compound are those having the formulae (C XIVA) and (C XIVB):

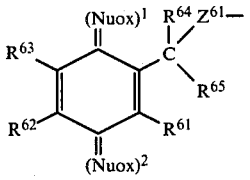

(C XIVA)

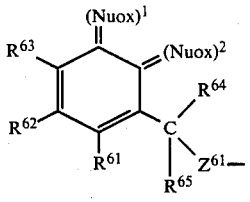

(C XIVB)

wherein $(Nuox)^1$ and $(Nuox)^2$ may be the same or different and each represents an oxidized nucleopholic group, and other notations are the same as defined with respect to formulae (C IX) and (C X). Specific examples of Y of this type are described in Japanese Patent Application Kokai Nos. 130927/79 and 154342/81.

The electron donors which may be used in combination are described in the patents and patent applications which are referred to with respect to formulae (C XII), (C XIII), (C XIVA) and (C XIVB) and incorporated herein by reference.

As still further different type of compound having the general formula (C I), there are illustrated linked donor acceptor (LDA) compounds. These compounds are dye-providing, nondiffusible substances which undergo donor-acceptor reaction in the presence of a base to release a diffusible dye, but upon reaction with an oxidation product of a developing agent, they substantially do not release the dye any more.

Examples of Y effective for this type of compound are those represented by the formula of (C XV):

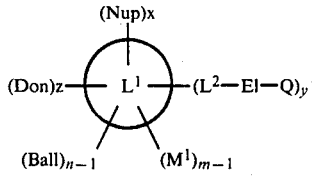

(C XV)

wherein n, x, y, and z each represent 1 or 2, m represents an integer of 1 or more; Don represents a group containing an electron donor or its precursor moiety; $L^1$ represents an organic group linking Nup to -E -Q or Don; Nup represents a precursor of a nucleophilic group; El represents an electrophilic center; Q represents a divalent group; Ball represents a ballast group; $L^2$ represents a linking group; and $M^1$ represents any desired substituent. Specific examples are described in Japanese Patent Application Kokai No. 60289/83.

The ballast group is an organic ballast group which can render the dye-providing substance nondiffusible, and is preferably a group containing a $C_{8-32}$ hydrophobic group. Such organic ballast group is attached to the dye-providing substance directly or through a linking group such as an imino bond, an ether bond, a thioether bond, a carbonamido bond, a sulfonamido bond, a ureido bond, an ester bond, a carbamoyl bond, a sulfamoyl bond, etc., and mixtures thereof.

Two or more types of the-dye providing substances may be employed in combination. In such a case two or more types of the dye-providing substances may be used together for purposes of providing the same hue or reproducing black color.

Specific examples of the image forming substances which can be used in the presnt invention are described in the patents cited hereinbefore. Only some typical, but non-limiting examples are described below because it is difficult and redundant to illustrate all preferred examples. Specific examples of the dye-providing substances having general formula (C I) are set forth below.

CI-1

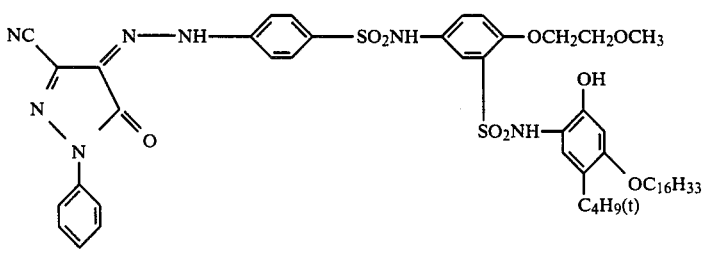

-continued
CI-2
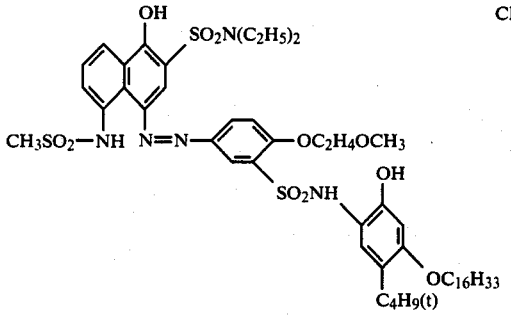
CI-3
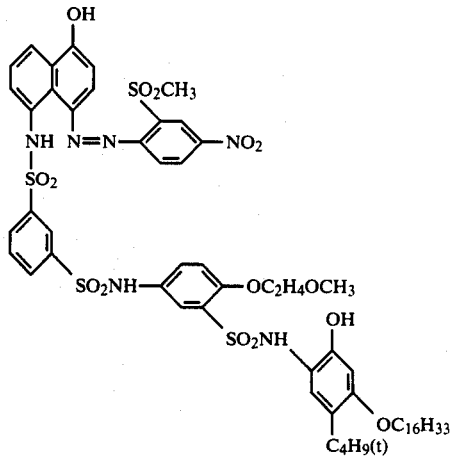
CI-4
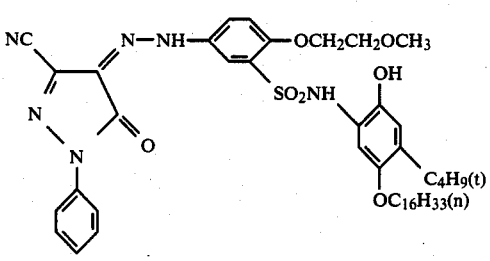
CI-5
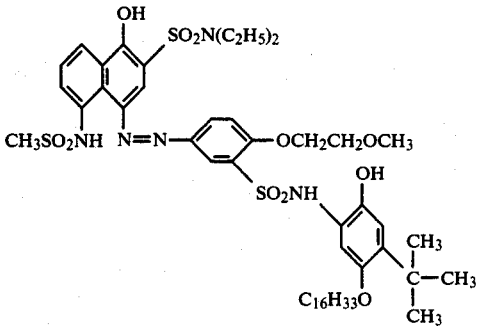
CI-6
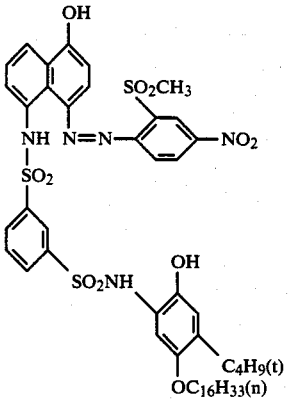
CI-7
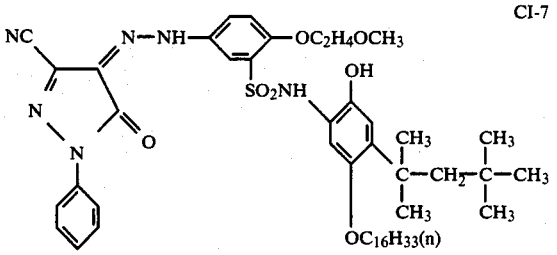
CI-8
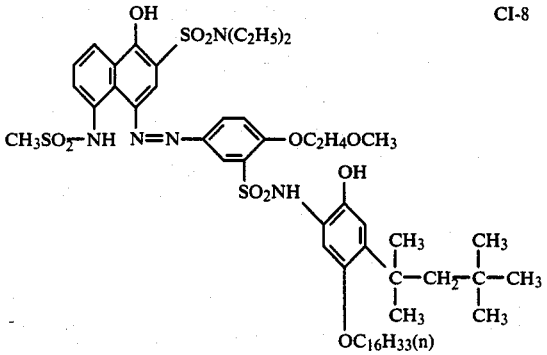
CI-9
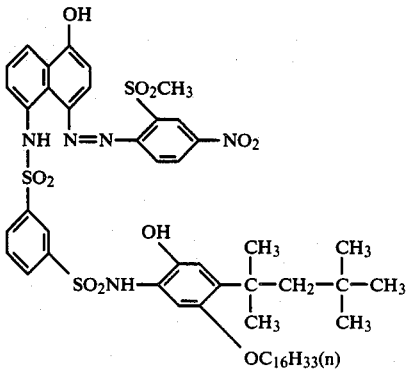

-continued

CI-10

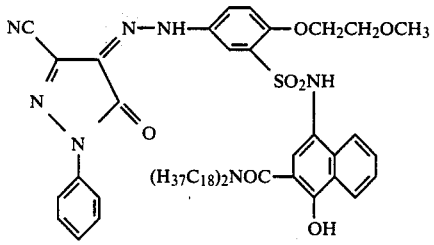

CI-11

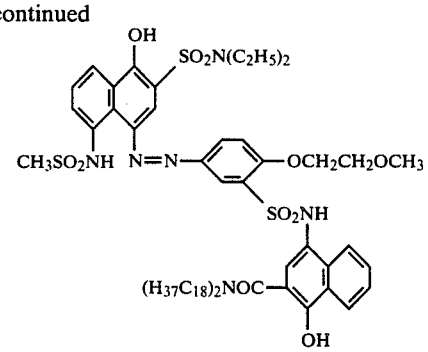

CI-12

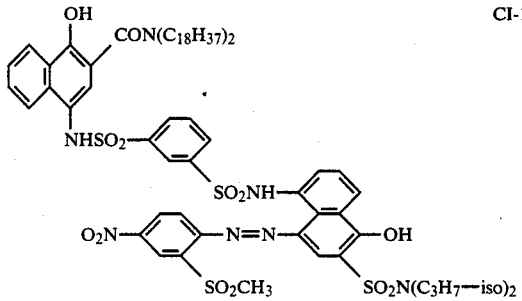

CI-13

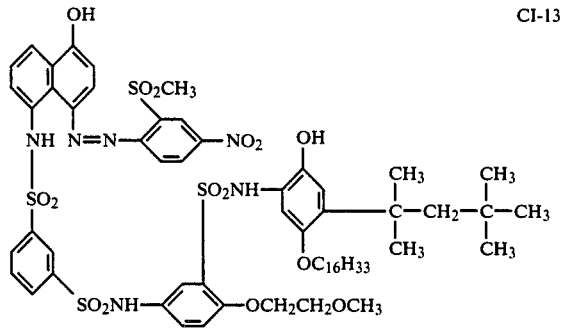

CI-14

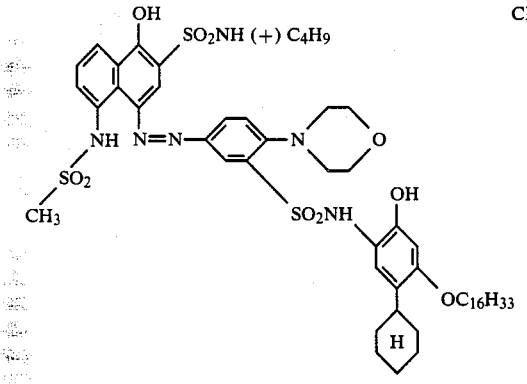

CI-15

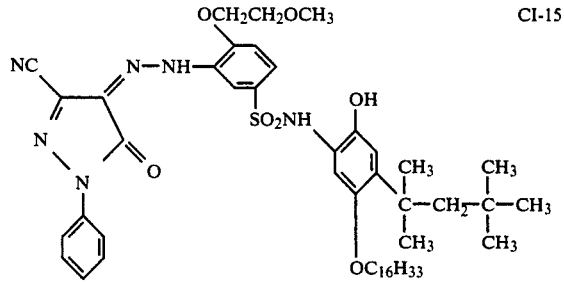

The dye-providing substances may generally be present in amounts of about 0.01 to 4 mols per mol of the silver salt.

The dye-releasing redox compounds used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye-releasing redox compound is first dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), and a trimesic acid ester (for example, tributyl trimesate, etc.), or an organic solvent having a boiling point of about 30° C. to 160° C., for example, a lower alkyl acetate such as ethyl acetate, butyl acetate, etc., ethyl propionate, sec-butyl alcohol, methyl isobutyl ketone, $\beta$-ethoxyethyl acetate, methyl cellosolve acetate, cyclohexanone, etc. Mixtures of the above described high boiling organic solvents and low boiling organic solvents may also be used. The solution of the dye-releasing redox compound may then be dispersed in a hydrophilic colloid.

Further, it is possible to use a method for dispersion in polymers as described in Japanese Patent Publication No. 39853/76 and Japanese Patent Application Kokai No. 59943/76. Moreover, various surface-active agents may be used when the dye-releasing redox compound is dispersed in a hydrophilic colloid. For this purpose, the surface-active agents illustrated in other part of the specification may be used.

In the present invention, a reducing agent may be used in the light-sensitive material if necessary.

The reducing agents used in the present invention include hydroquinone compounds such as hydroquinone, 2,5-dichlorohydroquinone, 2-chlorohydroquinone, etc.; aminophenol compounds such as 4-aminophenol, N-methylaminophenol, 3-methyl-4-aminophenol, 3,5-dibromo-aminophenol, etc.; catechol compounds such as catechol, 4-cyclohexylcatechol, 3-methoxycatechol, 4-(N-octadecylamino)catechol, etc.; phenylenediamine compounds such as N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.

Some illustrative examples of the more preferred reducing agents include 3-pyrazolidones such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 1-(2-trifluoroethyl)-4,4-dimethyl-3-pyrazolidone, and 5-methyl-3-pyrazolidone.

Various combinations of developing agents as described in U.S. Pat. No. 3,039,869 may also be used.

In the present invention, an amount of the reducing agent added is from 0.01 mol to 20 mols per mol of silver and more preferably from 0.1 mol to 10 mols per mol of silver.

A variety of dye-releasing assistants are also employable in the practice of the present invention. The dye-releasing assistants employable include compounds possessing basic nature and capable of acitivating development process, nucleophilic compounds, and bases or base precursors. The dye-releasing assistants may be contained in either light-sensitive materials or dye-fixing materials. The base precursors are advantageously used particularly in the former case.

Examples of the preferred bases include inorganic bases, for example, hydroxides, secondary and tertiary phosphates, borates, carbonates, quinolinates, and metaborates of alkali and alkaline earth metals; ammonium hydroxides; quaternary ammonium hydroxides; and hydroxides of other metals; and organic bases, for examples, aliphatic amines such as trialkylamines, hydroxylamines, and aliphatic polyamines; aromatic amines such as N-alkyl substituted aromatic amines, N-hydroxyalkyl substituted amines and bis[p-dialkylamino-phenyl]methanes; heterocyclic amines; amidines and cyclic amidines; guanidines and cyclic guanidines. Also useful are betaine tetramethyl ammonium iodide and diaminobutane dihydrochloride as disclosed in U.S. Pat. No. 2,410,644 and amino acid-containing organic compounds such as urea and 6-amino-caproic acid dislcosed in U.S. Pat. No. 3,506,444. Bases having a pKa value of at least 8 are particularly useful in the practice of the present invention.

The base precursors used herein are those compounds which undergo a certain reaction upon heating to release a base, including salts of organic acids and bases which are decomposed by heating through decarbonation and those compounds which are decomposed to release an amine through Lossen or Beckmann rearrangement.

The preferred base precursors are precursors of the afore-mentioned organic bases. Some illustrative examples are salts of such bases with thermally decomposable organic acids such as trichloroacetic acid, trifluoroacetic acid, propiolic acid, cyanoacetic acid, sulfonylacetic acid, and acetoacetic acid; and salts with 2-carboxylcarboxamide as disclosed in U.S. Pat. No. 4,088,496.

Examples of the preferred base precursors are presented below.

One class of those compounds whose acid moiety is decarbonated to release a base includes trichloroacetic acid derivatives such as guanidine trichloroacetic acid, pyperidine trichloroacetic acid, morpholine trichloroacetic acid, p-toluidine trichloroacetic acid, 2-picoline trichloroacetic acid, etc.

Base precursors as disclosed in British Pat. No. 998,945, U.S. Pat. No. 3,220,846, and Japanese Patent Application Kokai No. 50-22625 may also be used.

In addition to the trichloroacetic acids, useful are 2-carboxycarboxamide derivatives as disclosed in U.S. Pat. No. 4,088,496, α-sulfonylacetate derivatives as disclosed in U.S. Pat. No. 4,060,420, and propiolic acid derivatives as disclosed in Japanese Patent Application No. 58-55700. Those salts having alkali and alkaline earth metals as the basic component instead of the organic bases are also useful and disclosed in Japanese Patent Application No. 58-69597.

Other useful base precursors are those precursors based on Lossen rearrangement, for example, those hydroxamcarbamates disclosed in Japanese Patent Applciation No. 58-43860 and those aldoxime carbamates disclosed in Japanese Patent Applciation No. 58-31614.

Those amine imides disclosed in *Research Disclosure,* No. 15,776 (May 1977) and aldonamides disclosed in Japanese Patent Applciation Kokai No. 50-22625 are also preferably used because they are decomposed at elevated temperatures to produce a base.

The bases or base precursors mentioned above may be used not only for the purpose of promoting dye release, but also for other purposes, for example, pH adjustment.

In the practice of the present invention, a variety of development retarders may be used for the purpose of producing a consistent image independent of a change in temperature and time during heat development. The development retarders used herein are those compounds which after appropriate development, rapidly neutralize or react with a base to reduce the base concentration in the film to stop development, and more particularly, acid precursors capable of releasing an acid upon heating and those compounds capable of reacting with a coexisting base upon heating to reduce the base concentration. Examples of the former, acid precursors include oxime esters as disclosed in Japanese Patent Application No. 58-216928 and 59-48305, and compounds capable of releasing an acid through Lossen rearrangement as disclosed in Japanese Patent Application No. 59-85834. Examples of the latter, compounds capable of reacting with a base upon heating are disclosed in Japanese Patent Application No. 59-85836.

The development retarders of the type mentioned hereinafore exhibit their maximum effect particularly when the base precursors are used.

The ratio of the base precursor to the acid precursor preferably ranges from 1/20 to 20/1, and most preferably form 1/5 to 5/1 in molar ratio.

The silver halides used in the present invention include silver chloride, silver chlorobromide, silver chloroiodide, silver bromide, silver iodobromide, silver chloroiodobromide and silver iodide, but not limited thereto.

The process for preparing those silver halides is explained with reference to the preparation of silver iodobromide. That is, silver iodobromide is prepared by first adding silver nitrate solution to potassium bromide solution to form silver bromide particles and then adding potassium iodide to the mixture.

Mixtures of two or more silver halides having different particle size and/or halogen composition may be used.

The average particle size of the silver halide used in the present invention is preferably from 0.001 μm to 10 μm and more preferably from 0.001 μm to 5 μm.

The amount of the light-sensitive silver halide coated preferably ranges from 1 mg/m$^2$ to 10 g/m$^2$ of silver.

The silver halides used in the present invention may be applied with or without chemical sensitization with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above-described image-forming substance or a reducing agent optionally coexisting with the image-forming substance, when it is heated to a temperature of above 80° C. and, preferably, above 100° C. in the presence of exposed silver halide. The co-presence of the organic silver salt oxidizing agent allows the light-sensitive material to provide higher color density.

Examples of such organic silver salt oxidizing agents include those described in U.S. Pat. No. 4,500,626.

A silver salt of an organic compound having a carboxyl group may be used. Typical examples thereof include a silver salt of an aliphatic carboxylic acid and a silver salt of an aromatic carboxylic acid.

In addition, a silver salt of a combound containing a mercapto group or a thione group and a derivative thereof may be used.

Further, a silver salt of a compound containing an imino group may be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, organic metal salts such as copper stearate and a silver salt as described in *Research Disclosure,* Vol. 170, No. 17029 (June 1978) are included in the organic metal salt oxidizing agents which can be used in the present invention.

Methods of preparing these silver halides and organic silver salt oxidizing agents and blending them are described in *Research Disclosure,* No. 17029, Japanese Patent Application Kokai Nos. 13224/74, 17216/75, 32928/75 and 42529/76, and U.S. Pat. No. 3,700,458.

A total coating amount of the light-sensitive silver halide and the organic silver salt oxidizing agent employed in the present invention preferably ranges from 50 mg/m$^2$ to 10 g/m$^2$ of silver.

In the practice of the present invention, the binders may be employed alone or in combinations thereof. A hydrophilic binder may be used as the binder according to the present invention. The typical hydrophilic binder is a transparent or translucent hydrophilic colloid, examples of which include natural substances, for example, proteins such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another exmaple of the synthetic polymer compound is a dispersed vinyl compound in a latex form which is used for the purpose of increasing dimensional stability of a photographic material.

Further, in the present invention, it is possible to use a compound which activates development simultaneously with stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)bis(isothiuronium trifluoroacetate) etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Patent 4,012,260, compounds having α-sulfonylacetate as an acid part such as bis(2-amino-2-thiazolium)-methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive materials of the present invention may contain a toning agent if desired. Effective toning agents are 1,2,4-triazoles, 1H-tetrazoles, thiouracils, 1,3,4-thiadiazoles, and similar compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above generally ranges from about 0.001 to 0.1 mol per mol of silver in the photosensitive material although the exact content depends upon the type of a heat developable photosensitive material used, processing conditions, desired images and various other factors.

The above-described bases or base precursors may be used not only for the acceleration of dye release but also for other purposes such as pH control.

The above-described various ingredients to constitute a heat developable photosensitive material may be arranged in arbitrary positions, if desired. For instance, one or more of the ingredients may be incorporated in one or more of the constituent layers of a photosensitive material, if desired. In some cases, it is desired that particular proportions of reducing agent, image stabilizing agent and/or other additives be distributed in a protective layer. Such distribution of additives can reduce migration of additives among constituent layers of a heat developable photosensitive material and is thus of advantage in some cases.

The heat developable photosensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 may be used.

Various means of exposure may be used in the present invention. Latent images are obtained by imagewise exposure by radiant rays including visible rays. Generally, light sources used for conventional color prints may be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the material to a suitable elevated temperature. A higher or lower temperature can be utilized to prolong or shorten the heating time insofar as it is within the above-described temperature range.

Any desired heating means may be used, for example, a simple heat plate, iron, heat roller, heat generator utilizing carbon or titanium white, and the like.

The support and the optional dye-fixing material used in the light-sensitive material according to the present invention must withstand the processing temperature. As an ordinary support, not only glass, paper, metal and analogues, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc. may be used. Those polyesters described in U.S. Pat. Nos. 3,634,089 and 3,725,070 are preferably used.

In the photographic light-sensitive material and the dye-fixing material of the present invention, the photographic emulsion layer and other binder layers may contain inorganic or organic hardeners. It is possible to use chromium salts such as chromium alum, chromium acetate, etc.; aldehydes such as formaldehyde, glyoxal, glutaraldehyde, etc.; N-methylol compounds such as dimethylolurea, methylol dimethylhydantoin, etc.; dioxane derivatives such as 2,3-dihydroxydioxane, etc.; active vinyl compounds such as 1,3,5-triacryloyl-hexahydro-s-triazine, 1,3-vinylsulfonyl-2-propanol, etc.; active halogen compounds such as 2,4-dichloro-6-hydroxy-s-triazine, etc.; mucohalogenic acids such as mucochloric acid, mucophenoxychloric acid, etc. or the like alone or in combinations of two or more.

The transfer of dyes from the light-sensitive layer to the dye-fixing layer can be carried out using a dye transfer assistant.

The dye transfer assistants suitably used in supplying them from outside the system include water and an aqueous solution containing sodium hydroxide, potassium hydroxide or an inorganic alkali metal salt. Further, a low boiling solvent such as methanol, N,N-dimethylformamide, acetone, diisobutyl ketone, etc., and a mixture of such a low boiling solvent with water or alkaline aqueous solution can be used. The dye transfer assistant may be used by wetting the image receiving layer with the transfer assistant.

When the dye transfer assistant has been incorporated into the light-sensitive material or the dye-fixing material, the transfer assistant need not be supplied from the outside. The above-described dye transfer assistant may be incorporated into the material in the form of water of crystallization or microcapsules or as a precursor which releases a solvent at a high temperature.

More preferably, a hydrophilic thermal solvent which is solid at an ambient temperature and melts at a high temperature may be incorporated into the light-sensitive material or the dye-fixing material. The hydrophilic thermal solvent may be incorporated in the light-sensitive material and/or the dye fixing material. Although the solvent can be incorporated into any of the emulsion layer, the intermediate layer, the protective layer and the dye fixing layer, it is preferred to incorporate it into the dye fixing layer and/or layers adjacent thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dyes, antihalation and antiirradiation dyes, hardeners, mordants and so on, are those described in U.S. Pat. Nos. 4,500,626, 4,478,927, 4,463,079, and 4,503,137 and Japanese Patent Application No. 28928/83 (corresponding to U.S. patent application Ser. No. 582,655 filed on Feb. 23, 1984, now U.S. Pat. No. 4,559,290). Exposure and other techniques disclosed in the above-described patents may also be employed in the present invention.

The light-sensitive materials of the present invention may further contain other additives which are generally employed in such materials, for example, sulfamide derivaties, cationic compounds having pyridinium radical or the like, surfactants having a polyethylene oxide chain, halation- and irradiation-inhibiting dyes, hardening agents, and mordants as disclosed in European Patent Application (published) Nos. 76,492 and 66,282; West German Patent No. 3,315,485; and Japanese Patent Application Nos. 28,928/'83 and 26,008/'83. Any desired methods for exposure, development and post-treatments may be applied to the heat developable light-sensitive materials of the present invention as disclosed in the patent specifications previously incorporated herein by reference.

EXAMPLES

In order that those skilled in the art may better understand how the present invention may be practiced, the following examples are given by way of illustration and not by way of limitation.

EXAMPLE 1

Preparation of Silver Iodobromide Emulsion

Gelatin (40 g) and KBr (26 g) were dissolved in water (3,000 ml). The solution was agitated at 50° C. A solution of silver nitrate (34 g) in water (200 ml) was added to the KBr solution over a period of 10 minutes. To this solution, a solution of KI (3.3 g) in water (100 ml) was added over a period of 2 minutes. The thus prepared silver idobromide emulsion was adjusted to such pH that an excess salt precipitated out of the emulsion, and the excess salt filtered off. The emulsion was then adjusted to pH 6.0 to obtain a silver iodrobomide emulsion (yield: 400 g).

Preparation of Dispersion of Dye-Releasing Material

Ten grams of a dye-releasing material CI-2 having the following structure was dissolved together with 0.5 g of succinic acid-2-ethylhexyl ester sodium sulfonate surfactant and 20 g of tricresyl phosphate (TCP) solvent in 30 ml of ethyl acetate by heating at about 60° C. The solution was mixed with 100 g of a 10 wt % gelatin solution by agitation, and the mixture was dispersed using a homogenizer for 10 minutes at 10,000 rpm.

CI-2

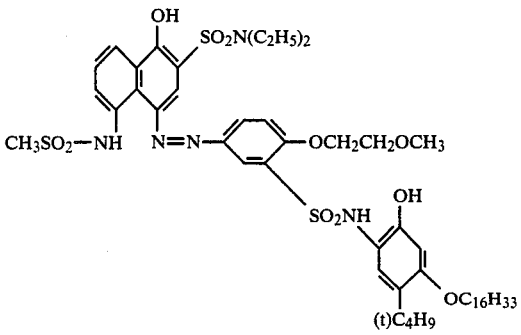

A light-sensitive coating composition was prepared from the following formulation.

| | | |
|---|---|---|
| (a) | Light-sensitive silver iodobromide emulsion | 25 g |
| (b) | Dispersion of dye-releasing material CI-2 | 33 g |
| (c) | Aqueous solution of 5 wt % compound having the formula: | 10 ml |

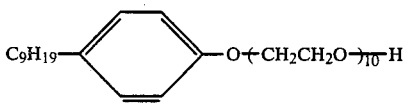

| | | |
|---|---|---|
| (d) | Solution of 1.5 g guanidine trichloroacetic acid in 15 ml ethanol | |
| (e) | Solution of 0.4 g $(CH_3)_2NSO_2NH_2$ in 4 ml methanol | |
| (f) | Solution of 0.2 g compound No. 1 of the invention in 4 ml methanol | |

Components (a) to (f) were combined and dissolved by heating. The solution was applied onto a polyethylene terephthalate film base to a wet thickness of 30 μm and then dried to form a light-sensitive material. The following composition was further applied onto the light-sensitive material as a protective layer to a wet thickness of 25 μm.

| Composition of the protective layer | |
|---|---|
| (a) 10% gelatin in water | 30 g |
| (b) water | 70 ml |

The coated material was imagewise exposed under a tungsten lamp of 2,000 lux for 10 seconds and uniformly heated on a heat block at 140° C. for 20 seconds to provide sample A.

Sample B was prepared by the same procedure as above except that 4 ml of methanol was used instead of component (f) containing the compound of the invention in Sample A. The sample was processed in the same manner as above.

Preparation of Dye-Fixing Material

Ten grams of methyl acrylate-co-N,N,N-trimethyl-N-vinylbenzylammonium chloride copolymer (molar ratio of methyl acrylate to vinylbenzyl ammonium chloride 1:1) was dissolved in 200 ml of water, and the solution was homogeneously mixed with 100 g of 10 wt % lime-treated gelatin. The resulting mixture was uniformly spread onto a paper substrate laminated with polyethylene, thereby forming a dye-fixing layer having a uniform wet thickness of 90 μm. The layer was dried to provide a dye-fixing material.

The dye-fixing material was dipped in water and recovered therefrom. Each of Samples A and B of the light-sensitive materials was heated and superimposed on a piece of the dye-fixing material in such a manner that the light-sensitive layer was in contact with the dye-fixing layer.

After heating on a heat block at 80° C. for 6 seconds, the dye-fixing materials were peeled from the light-sensitive materials to find that negative magenta color images were formed on the dye-fixing materials. The negative images were measured for maximum and minimum densities with a Macbeth (TD-504) transmission densitometer.

TABLE 1

| Sample | Dmax | Dmin |
|---|---|---|
| A (Invention) | 2.15 | 0.20 |
| B (Comparison) | 1.28 | 0.18 |

The data in Table 1 shows that the compound according to the present invention more markedly increases the maximum density without a substantial increase in minimum density than in the absence of the compound.

EXAMPLE 2

The procedure of Example 1 was repeated except that the compounds shown in Table 2 were used instead of compound No. 1. The results are also shown in the same table.

TABLE 2

| Sample | Compound | Amount added | Dmax | Dmin |
|---|---|---|---|---|
| C | Compound (2) | 0.23 g | 2.13 | 0.19 |
| D | Compound (5) | 0.25 g | 2.16 | 0.15 |
| E | Compound (6) | 0.25 g | 2.20 | 0.20 |
| F | Compound (10) | 0.25 g | 2.18 | 0.18 |
| G | Compound (11) | 0.25 g | 2.18 | 0.16 |

The data in Table 2 shows that the compound according to the present invention more markedly increases the maximum density without a substantial increase in minimum density.

EXAMPLE 3

Dispersions of dye-releasing materials were prepared by repeating the procedure of Example 1 except that the dye-releasing material was replaced by 10 grams of materials α and β having the following structures:

Dye-releasing material α (CI-7)

-continued

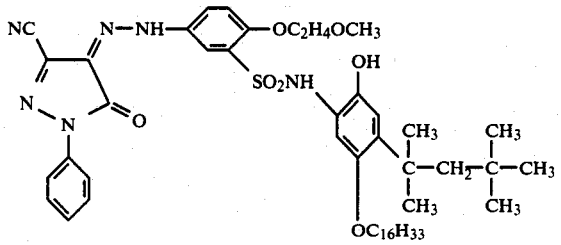

Dye-releasing material β

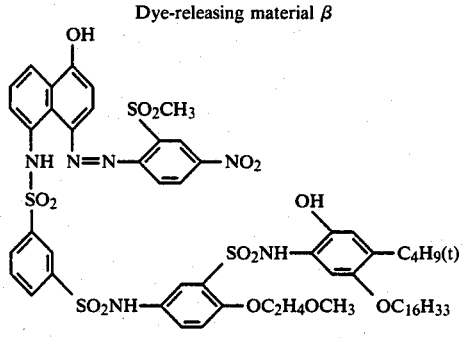

Samples were prepared and tested in the same manner as in Example 1. The results are shown in Table 3.

TABLE 3

| Dye-releasing material dispersion | Compound No. 1 of invention | Maximum density | Minimum density |
|---|---|---|---|
| Dispersion of α | present | 1.65 | 0.12 |
| Dispersion of α | absent | 0.65 | 0.11 |
| Dispersion of β | present | 2.28 | 0.20 |
| Dispersion of β | absent | 1.15 | 0.20 |

The data shows that the compound of the present invention provides a substantially high maximum density.

EXAMPLE 4

This example used an organic silver salt oxidizing agent.

Preparation of Silver Benzotriazole Emulsion

Gelatin (10 g) and benzotriazole (6.5 g) were dissolved in water (1,000 ml). The resulting solution was agitated at 50° C. A solution of silver nitrate (8.5 g) in water (100 ml) was added to the solution over a period of 2 minutes. A solution of potassium bromide (1.2 g) in water (50 ml) was added over a period of 2 minutes.

The resulting benzotriazole silver emulsion was adjusted to such pH that an excess salt precipitated, and the excess salt was filtered off. The emulsion was then adjusted to pH 6.0, obtaining a silver benzotriazole emulsion in a yield of 200 g.

Using the silver benzotriazole emulsion, a light-sensitive coating composition was prepared from the following formulation.

| | | |
|---|---|---|
| (a) | Silver benzotriazole emulsion Containing light-sensitive silver bromide | 10 g |
| (b) | Dispersion of dye-releasing material (as prepared in Example 1) | 3.5 g |
| (c) | Solution of 0.35 g of the following Compound in 3 ml of 50/50 water/ethanol | |

-continued

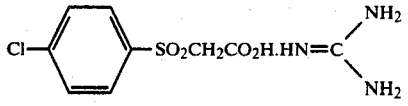

| | | |
|---|---|---|
| (d) | Aqueous solution of 5 wt % compound having the formula: | 1.5 ml |

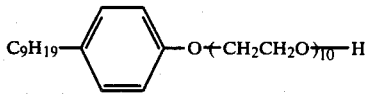

| | |
|---|---|
| (e) | Solution of 0.3 g $H_2NSO_2N(CH_3)_2$ in 4 ml ethanol |
| (f) | Solution of 0.2 g compound No. 5 of the invention in 4 ml ethanol |

Components (a) to (f) were combined. Using the mixture, Sample H was prepared by following the same procedure as in Example 1. The sample was also processed as in Exmaple 1. The results are shown below.

Control sample I which was free of component (f) or the compound of the invention was prepared and tested in the same manner as in Example 1. The results are shown in Table 4.

TABLE 4

| Sample | Maximum density | Minimum density |
|---|---|---|
| H (invention) | 2.20 | 0.21 |
| I (control) | 1.20 | 0.18 |

The date in Table 4 shows that the compound of the invention provides a high maximum density.

EXAMPLE 5

There was prepared the same emulsion as in Example 4.

A dye-releasing material dispersion was prepared by following the procedure of Example 1 except that the dye-releasing material used was 10 grams of a compound having the following structure:

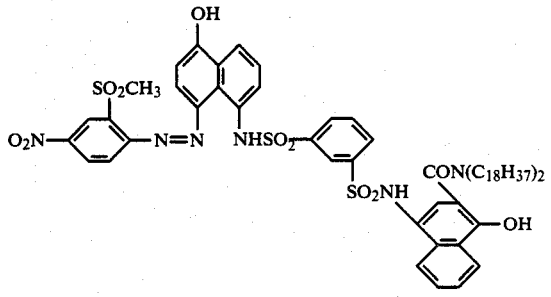

Using the emulsion and the dispersion, a light-sensitive coating composition was prepared from the following formulation:

| | | |
|---|---|---|
| (a) | Silver benzotriazole emulsion containing light-sensitive silver bromide (as used in Example 4) | 10 g |
| (b) | Dispersion of dye-releasing material | 3.5 g |
| (c) | Solution of 0.3 g of compound No. 11 of the invention in 4 ml of ethanol | |
| (d) | Solution of 0.2 g of the following compound in 4 ml of water | |

-continued

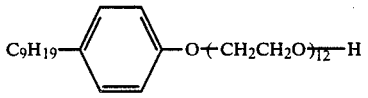

(e) Solution of 0.3 g of $(CH_3)_2NSO_2NH_2$ in 4 ml of ethanol

Components (a) to (e) were mixed and dissolved by heating. The solution was applied onto a polyethylene terephthalate film of 180 μm thick to form a light-sensitive layer having a wet thickness of 30 μm. The web was dried and imagewise exposed under a tungsten lamp of 200 lux for 10 seconds and then uniformly heated on a heat block at 160° C. for 30 seconds. This sample was designated J.

Control Sample K was prepared by the same procesure as above except that component (c) containing the compound of the invention was replaced by 4 ml of ethanol.

The formation of dye-fixing material and the subsequent treatment were the same as in Example 1.

The results are shown in Table 5.

TABLE 5

| Sample | Maximum density | Minimum density |
|---|---|---|
| J (invention) | 1.62 | 0.28 |
| K (control) | 0.85 | 0.22 |

The data in Table 5 shows that the use of the compound of the invention results in an increased maximum density as compared with the control.

As evident from the data in Examples, the heat developable, photographic light-sensitive materials of the present invention can be developed to produce images having an increased maximum density with less fogging by heating at a relatively low temperature for a short time because of the presence of the compounds capable of ring-closure to produce a benzimidazole ring upon heat development. The compounds according to the present invention are thus found to be very effective development accelerators.

We claim:

1. A heat developable light-sensitive material comprising a support having provided thereon at least a light-sensitive silver halide, a binder a reducing substance, and a development accelerating compound capable of ring-closure to produce a benzimidazole ring upon heat development wherein said compound capable of ring-closure is not a benzimidazole.

2. The heat developable light-sensitive material of claim 1 wherein said compound capable of ring-closure to -produce a benzimidazole ring upon heat development is represented by one of the following general formulae [I] through [XII]:

(I)

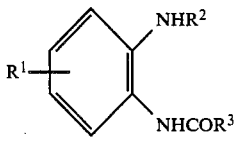

-continued (II)

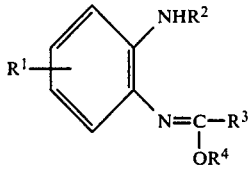

(III)

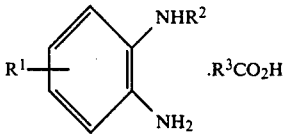

(IV)

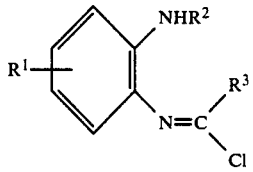

(V)

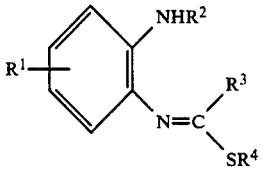

(VI)

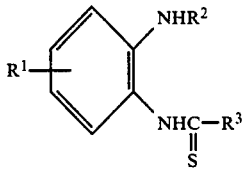

(VII)

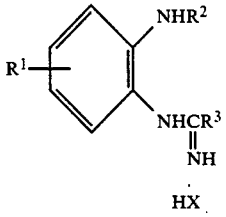

(VIII)

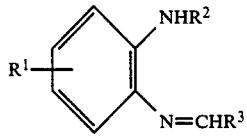

(IX)

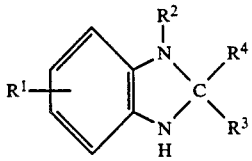

(X)

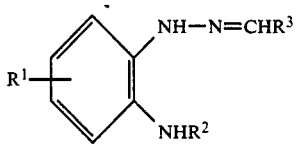

-continued (XI)

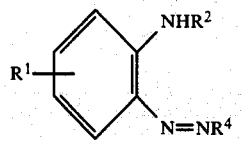

(XII)

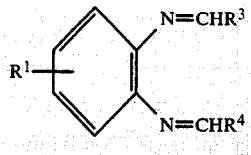

wherein:

$R^1$ represents a hydrogen atom, a halogen atom, a substituted of unsubstituted alkyl radical, a substituted or unsubstituted cycloalkyl radical, a substituted or unstubstituted alkenyl radical, a substituted or unsubstituted aryl radical, a substituted or unsubstituted aralkyl radical, an alkoxy radical, a substituted or unstubstituted aryloxy radical, a cyano radical, a nitro radical, an alkylsulfonyl radical, an arylsulfonyl radical, a substituted or unsubstituted sulfamoyl radical, a substituted or unsubstituted carbamoyl radical, a substituted or unsubstituted amino radical, an alkylacylamino radical, an arylacylamino radical, an alkylsulfonylamino radical, or an arylfulfonylamino radical;

$R^2$, $R^3$, and $R^4$ individually represent a hydrogen atom, a substituted or unsubstituted alkyl radical, a substituted or unsubstituted aralkyl radical, a substituted or unsubstituted aryl radical, a substituted or unsubstituted amino radical, an alkoxy radical, or an alkylthio radical.

3. The heat developable light-sensitive material of claim 2 wherein said compound capable of ring-closure to produce a benzimidazole ring upon heat development is represented by formula [I], [II], [VII]or [VIII].

4. The heat developable light-sensitive material of claim 1 wherein said compound capable of ring-closure to produce a benzimidazole ring upon heat development is present in an amount of less than about 100% by weight of the light-sensitive silver halide.

5. The heat developable light-sensitive material of claim 4 wherein said compound capable of ring-closure to produce a benzimidazole ring upon heat development is present in an amount of 0.1 to 50% by weight of the light-sensitive silver halide.

6. The heat developable light-sensitive material of claim 1 wherein the material further contains a dye providing substance.

7. The heat developable light-sensitive material of claim 6 wherein the dye providing substance is represented by the following general formula [CI]:

$$(\text{Dye - X})_q\text{-Y} \qquad [\text{CI}]$$

wherein Dye represents a dye which becomes mobile when it is released from the molecule of the compound represented by formula [CI]; X represents a simple bond or a connecting group; Y represents a group which releases Dye in correspondence or countercorrespondence to light-sensitive silver halide having latent image distributed imagewise, the diffusibility of Dye released being different from that of the compound represented by formula [CI]; and q represents an integer of 1 or 2.

8. A heat developable light-sensitive material as set forth in claim 1 wherein said compound is incorporated in a silver halide emulsion layer or a layer adjacent thereto.

9. A method for producing an image, which comprises heat developing a heat developable light-sensitive material comprising a support having provided thereon at least a light-sensitive silver halide, a binder, a reducing substance and a development accelerating compound capable of ring-closure to produce a benzimidazole ring upon heat development wherein said compound capable of ring-closure is not a benzimidazole.

* * * * *

UNITED STATES PATENT AND TRADEMARK OFFICE
CERTIFICATE OF CORRECTION

PATENT NO. : 4,675,277
DATED : SATO et al
INVENTOR(S) : June 23, 1987

It is certified that error appears in the above-identified patent and that said Letters Patent is hereby corrected as shown below:

IN THE CLAIMS:

COLUMN 32, between lines 55 and 60, delete the following structural formula:

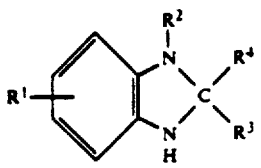

(IX)

Signed and Sealed this

Twenty-ninth Day of November, 1988

*Attest:*

DONALD J. QUIGG

*Attesting Officer*

*Commissioner of Patents and Trademarks*